US009592430B1

(12) United States Patent
Pollard

(10) Patent No.: US 9,592,430 B1
(45) Date of Patent: Mar. 14, 2017

(54) PORTABLE PUTTING CUP WITH ATTACHED BASKETBALL HOOP

(71) Applicant: Owen Craig Pollard, Vista, CA (US)

(72) Inventor: Owen Craig Pollard, Vista, CA (US)

( * ) Notice: Subject to any disclaimer, the term of this patent is extended or adjusted under 35 U.S.C. 154(b) by 0 days.

(21) Appl. No.: 14/878,638

(22) Filed: Oct. 8, 2015

(51) Int. Cl.
*A63B 69/36* (2006.01)
*A63B 63/08* (2006.01)

(52) U.S. Cl.
CPC ..... *A63B 63/08* (2013.01); *A63B 57/40* (2015.10)

(58) Field of Classification Search
USPC ..... 473/163, 164, 165, 166, 170, 172, 190, 473/192, 193, 195
See application file for complete search history.

(56) References Cited

U.S. PATENT DOCUMENTS 4,750,744 A * 6/1988 Michalec ..... A63B 63/00 473/195
5,492,319 A * 2/1996 Lee ..... A63B 69/3623 473/166
5,655,972 A * 8/1997 Heitzman ..... A63B 63/08 473/172
2003/0078111 A1* 4/2003 Wenzler ..... A63B 69/3623 473/197
2005/0197197 A1* 9/2005 Scott ..... A63B 63/08 473/173

* cited by examiner

*Primary Examiner* — Nini Legesse
(74) *Attorney, Agent, or Firm* — John R. Ross; John R. Ross, III

(57) ABSTRACT

A putting cup. A base portion has a ramp that is adjacent to the cup. A backboard is attached to the base portion and includes a hoop that is positioned over the cup. A user can hit a golf ball up the ramp so that the golf ball will fall through the hoop into the cup. In a preferred embodiment the user hits the golf ball so that it contacts the backboard and falls through the hoop. In another preferred embodiment the user hits the golf ball so that it falls through the hoop directly without hitting the backboard. In another preferred embodiment the user hits the golf ball so that it rolls up the ramp and into the cup without falling through the hoop. In another preferred embodiment the user hits the golf ball so that it travels into the cup through a passageway in the ramp. In a preferred embodiment, the ramp is a concave ramp that is circular in shape and surrounds the cup.

8 Claims, 8 Drawing Sheets

PORTABLE PUTTING CUP WITH ATTACHED BASKETBALL HOOP

The present invention relates to golf training and recreation devices, and in particular, to golf training and recreation devices for putting.

BACKGROUND OF THE INVENTION

There are many golf training devices available for the golfer and consumer designed to improve all parts of the game. A golfer can purchase a device to improve his drive, his chip shot or his putt. He can buy books and videos on how to improve his swing and concentration. He can follow fitness programs designed to increase his strength and stamina.

Portable putting cups are commonly available for purchase. Golfers will sometime purchase a portable putting cup for their home office or living room. Sometimes businesses will have a portable putting cup set up for use and practice. Often, however, these devices quickly lose their luster and are ignored.

In general, golfers will tend to improve if they play and practice more often. The goal is to provide to the golfer a practice device that the golfer will enjoy using. Practice devices that are also fun are more likely to be used by more people and for a longer period of time. If the golfer is having fun and being entertained, he will practice more and thereby improve his game.

What is needed is an improved golf putting cup that is fun and enjoyable for the golfer.

SUMMARY OF THE INVENTION

The present invention provides a putting cup. A base portion has a ramp that is adjacent to the cup. A backboard is attached to the base portion and includes a hoop that is positioned over the cup. A user can hit a golf ball up the ramp so that the golf ball will fall through the hoop into the cup. In a preferred embodiment the user hits the golf ball so that it contacts the backboard and falls through the hoop. In another preferred embodiment the user hits the golf ball so that it falls through the hoop directly without hitting the backboard. In another preferred embodiment the user hits the golf ball so that it rolls up the ramp and into the cup without falling through the hoop. In another preferred embodiment the user hits the golf ball so that it travels into the cup through a passageway in the ramp. In a preferred embodiment, the ramp is a concave ramp that is circular in shape and surrounds the cup.

DETAILED DESCRIPTION OF THE PREFERRED EMBODIMENTS

Figure 1:
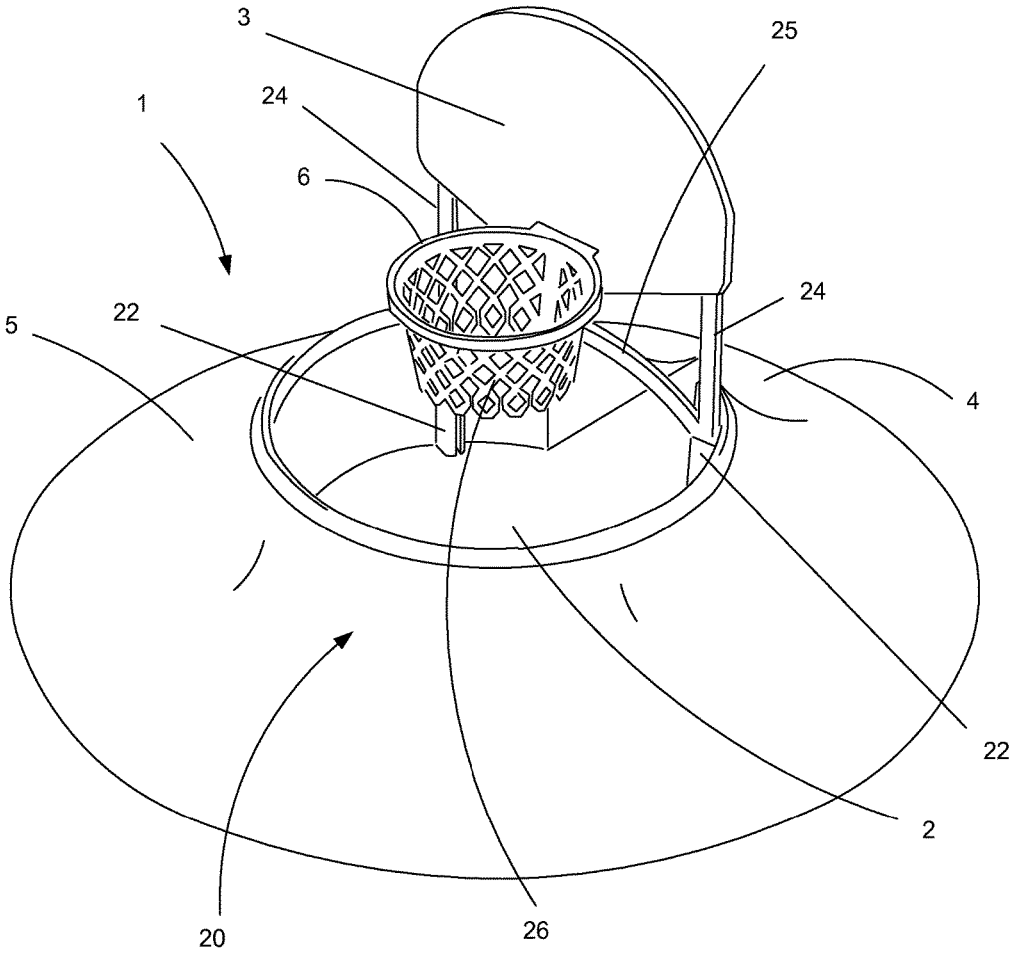
FIGS. 1 and 2 show a preferred embodiment of the present invention.
Figure 2:
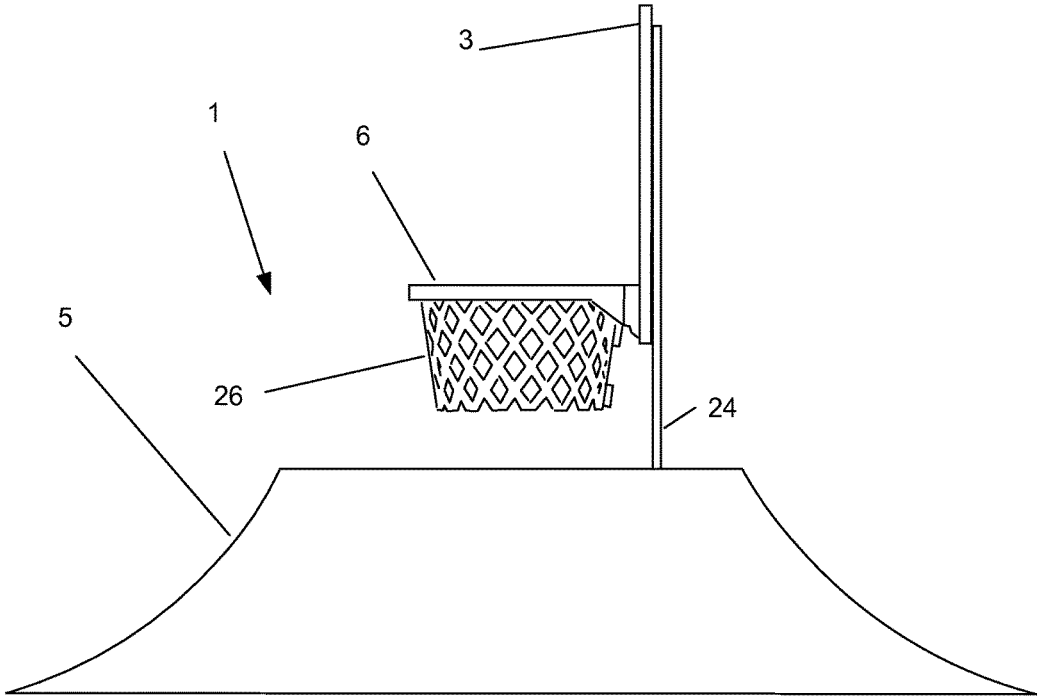

FIG. 1 shows a perspective view and FIG. 2 shows a side view of a preferred embodiment of the present invention. In a preferred embodiment of the present invention, the user is able to hit a golf ball towards portable putting cup 1 with the goal of getting the golf ball inside cup 2. If the golf ball is located behind backboard 3, the user can hit the ball into cup 2 by directing the ball so that it rolls through passageway 4. If located in front of backboard 3 or to the side of backboard 3, the user can hit the golf ball so that it rolls up ramp 5 and into cup 2. Or the user can hit the golf ball with greater force so that the golf ball bounces of backboard 3 and into hoop 6. Or, if the user has great skill, he can hit the golf ball up ramp 5 so that it travels through the air and goes directly into hoop 6 directly, without first bouncing off backboard 3.

Assembly of the Putting Cup

Figure 5:
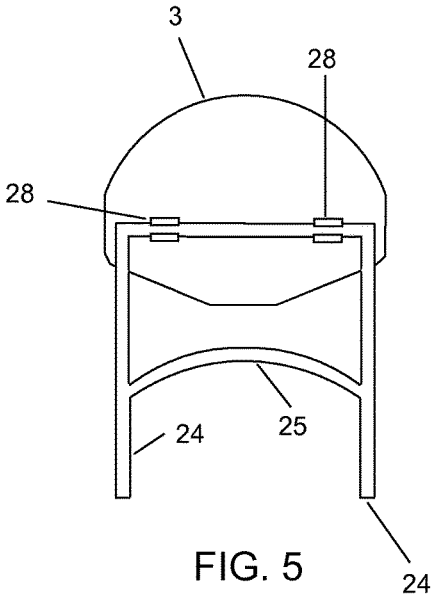
FIG. 5 shows a rear view of the backboard.

In a preferred embodiment of the present invention, the parts of putting cup 1 are fabricated from injection molded plastic. Putting cup 1 includes base portion 20 and backboard 3. Backboard 3 is rigidly connected to backboard leg supports 24 via snaps 28 (FIG. 5). Crossbeam 25 adds additional lateral support. Hoop 6 having net 26 is snap fit to backboard 3 for a rigid connection.

Base portion 20 includes concave ramp 5. In a preferred embodiment concave ramp 5 is circular in shape and surrounds and is concentric with cup 2. Concave ramp 5 is preferably interrupted by passageway 4. Passageway 4 allows a passageway for putting the golf ball into cup 2 without having to utilize ramp 5. Passageway 4 is preferably positioned so that it allows a golf ball to be putted into cup 2 from behind backboard 3 so that the ball travels underneath backboard 3 and hoop 6, as shown in FIG. 1.

Figure 3:
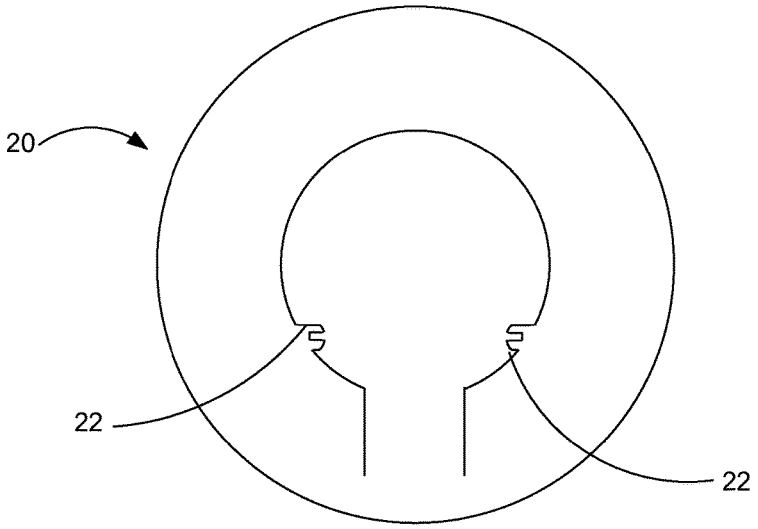
FIG. 3 shows a top view of the base portion.
Figure 4:
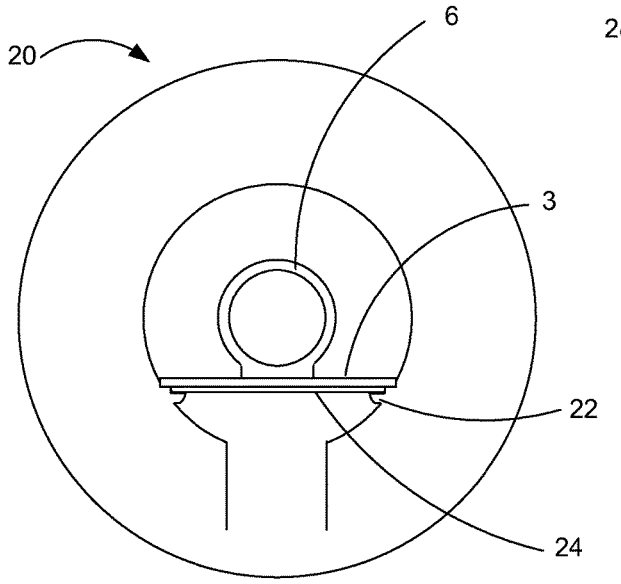
FIG. 4 shows a top view of the backboard attached to the base portion.

Leg supports 24 are slid fit into leg slots 22 of base portion 20. FIG. 3 shows a top view of base portion 20 having leg slots 22. FIG. 4 shows a top view of leg supports 24 slid into leg slots 22 for a snug fit. In a preferred embodiment of the present invention hoop 6 is positioned so that it is concentric with the circle formed by cup 2 so that hoop 6 is positioned directly over the center of cup 2 (as shown in FIG. 4).

Utilization of the Putting Cup Playing the Golf Ball Off the Backboard

Figure 6:
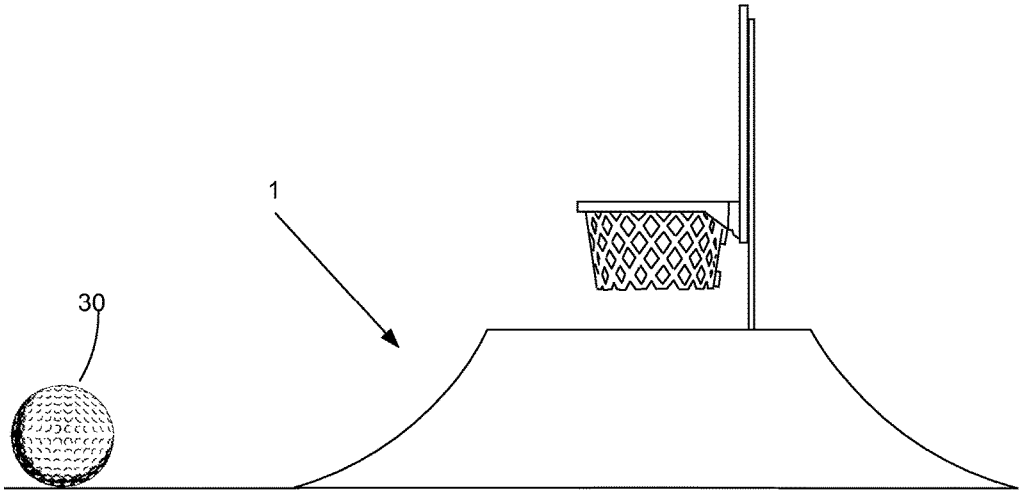
FIGS. 6-13 show preferred methods for utilizing the present invention.

In a preferred embodiment of the present invention, the user putts the golf ball so that it runs up ramp 5, flies through the air, bounces off backboard 3 and falls through hoop 6 into cup 2. For example, in FIG. 6 the user has putted golf ball 30 towards putting cup 1.

Figure 7:
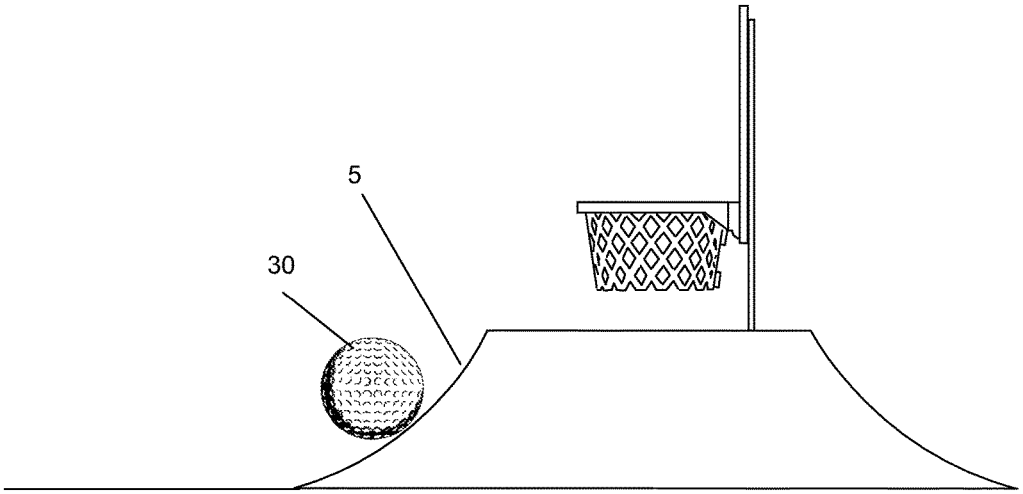

In FIG. 7, golf ball 30 is running up ramp 5.

Figure 8:
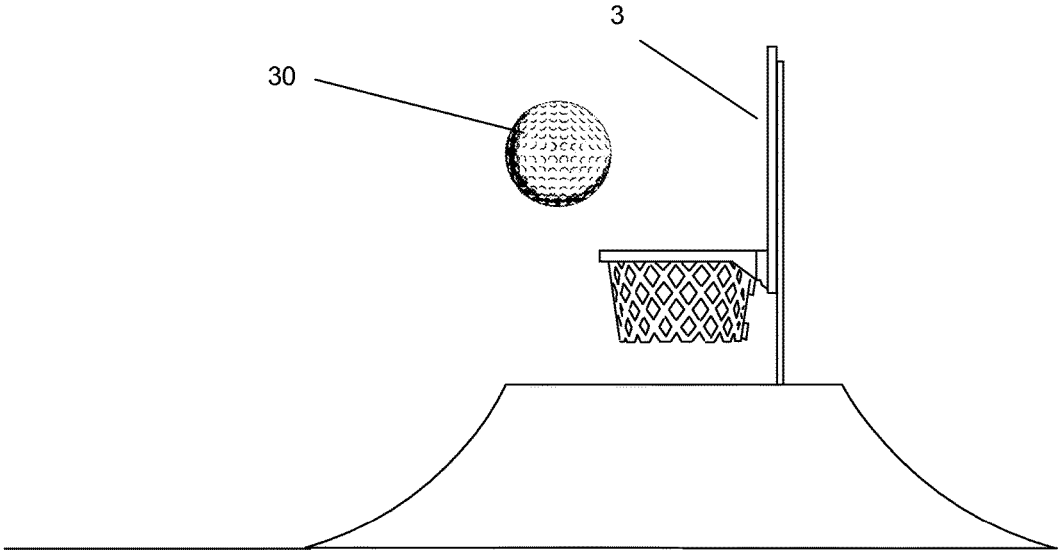

In FIG. 8, golf ball 30 is flying through the air towards backboard 3.

Figure 9:
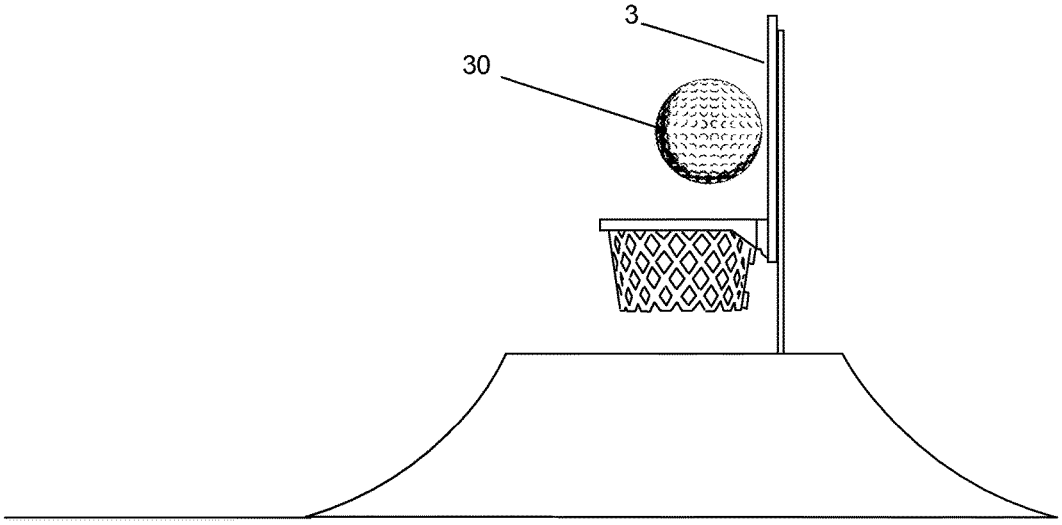

In FIG. 9, golf ball 30 has contacted backboard 3.

Figure 10:
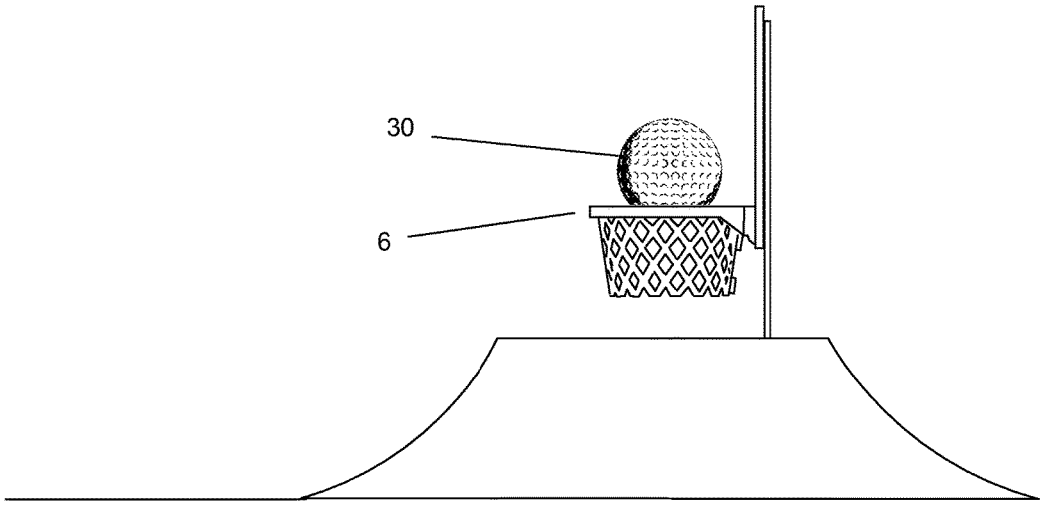
Figure 11:
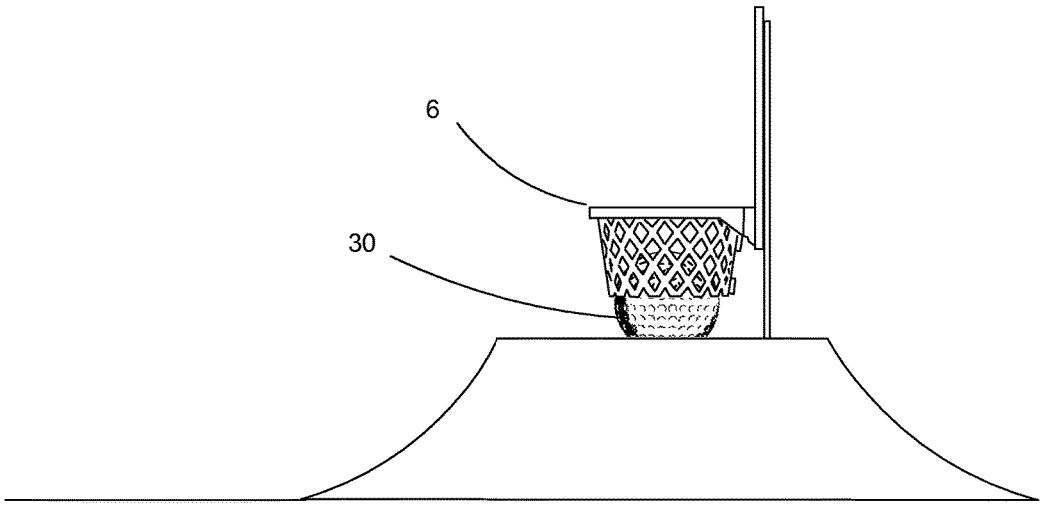

In FIGS. 10 and 11, golf ball 30 is falling through hoop 6 into cup 2.

Figure 12:
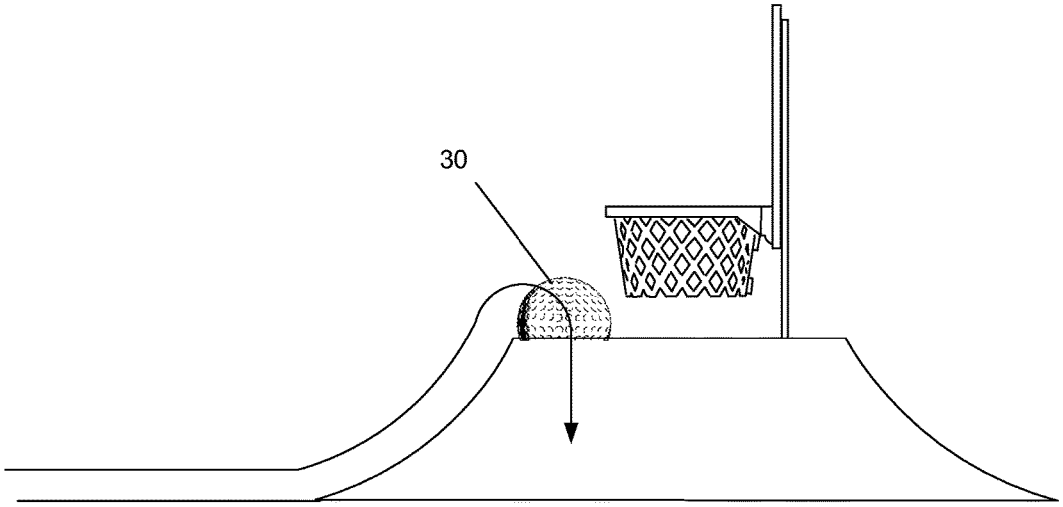

Putting the Golf Ball so that it Rolls up the Ramp and into the Cup In FIG. 12 the user has putted golf ball 30 with less force so that it smoothly rolls up ramp and into cup 2 without going through the air or contacting backboard 3.

Figure 13:
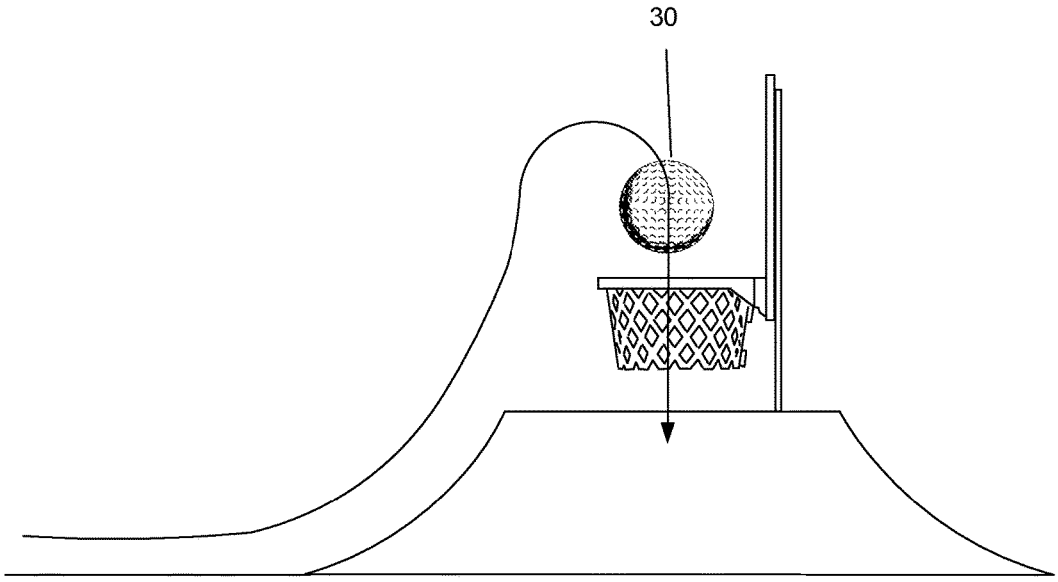

Putting the Golf Ball with Increased Force so that it Falls Through Hoop 6 without Contacting the Backboard In FIG. 13, the user has increased the force of the putt so that golf ball 30 flies through the air after leaving ramp 5 and falls directly through hoop 6 without any contact with backboard 3.

Games that can be Played with the Putting Cup

The following is a short outline description of games that can be played utilizing a preferred embodiment of the present invention:

- Hot Shots Game
  - Players Needed
    - 1 or more
  - How the game is Played
    - Player(s) get 10 putts from 2' or more
      - The total high points scored from the 10 putts wins
        - 1 point for getting into the cup only
        - 2 points for making into the basket from straight on
        - 3 points for making a side shot
      - Bonus Shot
        - The back of the cup has a small opening. To earn 1 bonus point golfer must putt from no more than 3 feet and make it into the opening.
- Traditional "Horse" Game
  - Players Needed
    - 2 or more
  - How Game is Played (same as basketball version)
    - Player One Putts from any distance and must call either "in the cup or In the hoop"
    - Players two must try and repeat Players One's shot if he makes it or get's to choose his own putt/shot if Player One misses.
    - Any missed shot following a made shot results in a letter until the word "Horse" is spelled out.
- Lightning
  - 2 or more Players needed
  - How The Game is Played
    - Player 1 putts and tries to make a basket from any distance or side. He/she must make a basket before Player 2 makes a basket. If player one makes their first basket they try and make a second basket prior to player 2 making their first basket. If Player one misses and Player 2 makes a basket before Player 1 makes their first basket player 2 wins. Player 1 or Player 2 must make two baskets in a row prior to the other player making one. Any combination of either player making two baskets in a row that player wins.
    - All Players putt at the same time except for the start of the game where Player 1 is the first to putt.
- Long Shots
  - 2 or more Players needed
  - How The Game is Played
  - Player one selects a distance and attempts a put. If Player 1 makes that shot/putt they stand where they attempted the putt. Then Player 2 attempts an equal distance putt to stay in the game or goes for a longer putt to force Player 1 to attempt that new distance. A player wins when he successfully makes a putt that the other player cannot.

While the present invention has been described in terms of preferred embodiments, the reader should consider these described embodiments only as particular embodiments. Many other embodiments are possible. Therefore, the reader should determine the scope of the present invention by the claims and their legal equivalents.

What is claimed is:

1. A putting cup, comprising:

A. a base portion comprising:

1. a ramp, and
2. a cup, wherein said ramp is positioned adjacent to said cup,

B. a backboard attached to said base portion and positioned adjacent to said cup, and C. a hoop connected to said backboard, said hoop positioned over said cup, wherein a golf ball hit up said ramp is capable of falling through said hoop into said cup, wherein said ramp is a concave ramp that is circular in shape and surrounds said cup.

2. The putting cup as in claim 1, ramp comprises a passageway to said cup that allows for a golf ball to roll into said cup without rolling up said ramp.

3. The putting cup as in claim 2, wherein said passageway is positioned to allow a golf ball to roll under said backboard from behind said backboard.

4. A putting cup, comprising:

A. a base portion comprising:

1. a ramp, and
2. a cup, wherein said ramp is positioned adjacent to said cup,

B. a backboard attached to said base portion and positioned adjacent to said cup, and C. a hoop connected to said backboard, said hoop positioned over said cup, wherein a golf ball hit up said ramp is capable of falling through said hoop into said cup, wherein said base portion comprises leg slots for receiving said backboard.

5. The putting cup as in claim 4, wherein said backboard is connected to backboard leg supports and said backboard leg supports are slidingly attached to said leg slots.

6. The putting cup as in claim 1, wherein said hoop comprises a net attached to said hoop.

7. The putting cup as in claim 1, wherein said base portion, said backboard and said hoop are fabricated from injection molded plastic.

8. A putting cup, comprising:

A. a base portion comprising:

1. a ramp, and
2. a cup, wherein said ramp is positioned adjacent to said cup,

B. a backboard attached to said base portion and positioned adjacent to said cup, and C. a hoop connected to said backboard, said hoop positioned over said cup, wherein a golf ball hit up said ramp is capable of falling through said hoop into said cup, wherein said hoop is concentric to said cup.

* * * * *